US005882076A

United States Patent [19]

Garelick et al.

[11] Patent Number: 5,882,076

[45] Date of Patent: Mar. 16, 1999

[54] LOCK FOR ROTATABLE BOAT SEAT

[75] Inventors: Richard J. Garelick, Minneapolis; Paul A. Pilosi, Minnetonka, both of Minn.

[73] Assignee: Garelick Mfg. Co., St. Paul Park, Minn.

[21] Appl. No.: 944,645

[22] Filed: Oct. 6, 1997

Related U.S. Application Data

[60] Provisional application No. 60/037,028 Feb. 5, 1997.

[51] Int. Cl. [6] ..... A47C 1/02

[52] U.S. Cl. ..... 297/344.18; 297/344.22; 248/411

[58] Field of Search ..... 297/344.18, 344.21, 297/344.22, 344.24; 248/188.5, 411, 412, 161; 403/110, 321, 104; 114/363

[56] References Cited

U.S. PATENT DOCUMENTS

| | | | |
|---|---|---|---|
| 548,498 | 10/1895 | Andrew | 248/411 |
| 1,611,432 | 12/1926 | Gladstone | 248/411 X |
| 3,533,583 | 10/1970 | Azim | 248/411 X |
| 3,910,633 | 10/1975 | Marsh | 297/344.22 |
| 4,596,484 | 6/1986 | Nakatani | 248/411 X |
| 4,645,462 | 2/1987 | Fulton | 114/363 X |
| 4,744,690 | 5/1988 | Hsieh | 248/411 X |
| 5,297,849 | 3/1994 | Chancellor | 297/344.22 X |

FOREIGN PATENT DOCUMENTS

| | | | |
|---|---|---|---|
| 4104 | 7/1898 | United Kingdom | 403/110 |
| 852779 | 11/1960 | United Kingdom | 403/110 |

OTHER PUBLICATIONS

Pp. 22–24 Garelick Marine Products Catalog Copyright 1996.

*Primary Examiner*—Laurie K. Cranmer
*Attorney, Agent, or Firm*—Jacobson and Johnson

[57] ABSTRACT

A boat seat is rotatably supported on a tubular deck-mounted support post or column by a yoke having an annular extension engaging said tubular support. A locking plate having ridges or teeth for engaging slots on the exterior of the tubular support is mounted on the yoke and is selectively movable into locking engagement with said slots by a lever arm to positively prevent rotation of the boat seat. A spring biases the locking plate out of locking engagement when the lever arm is moved to the unlock position.

8 Claims, 6 Drawing Sheets

6
11
10
9
8
7

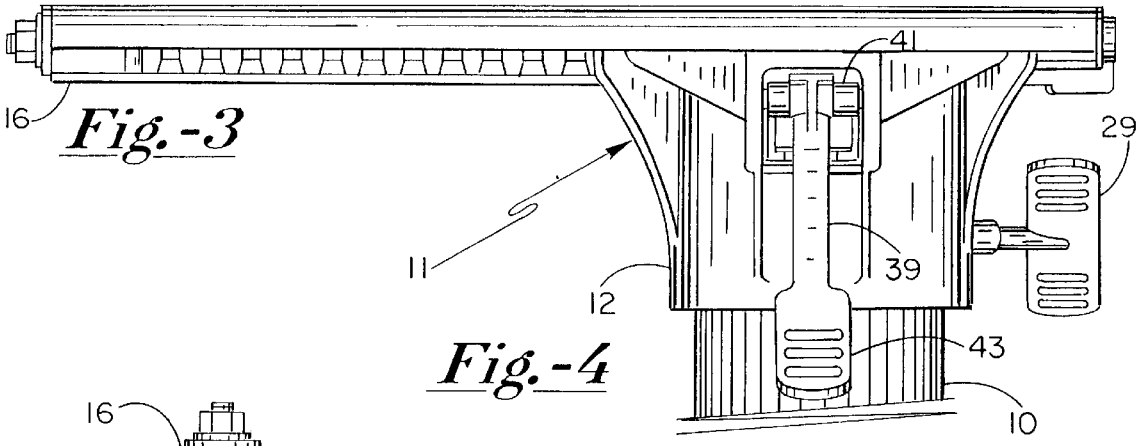
Fig.-3
Fig.-4
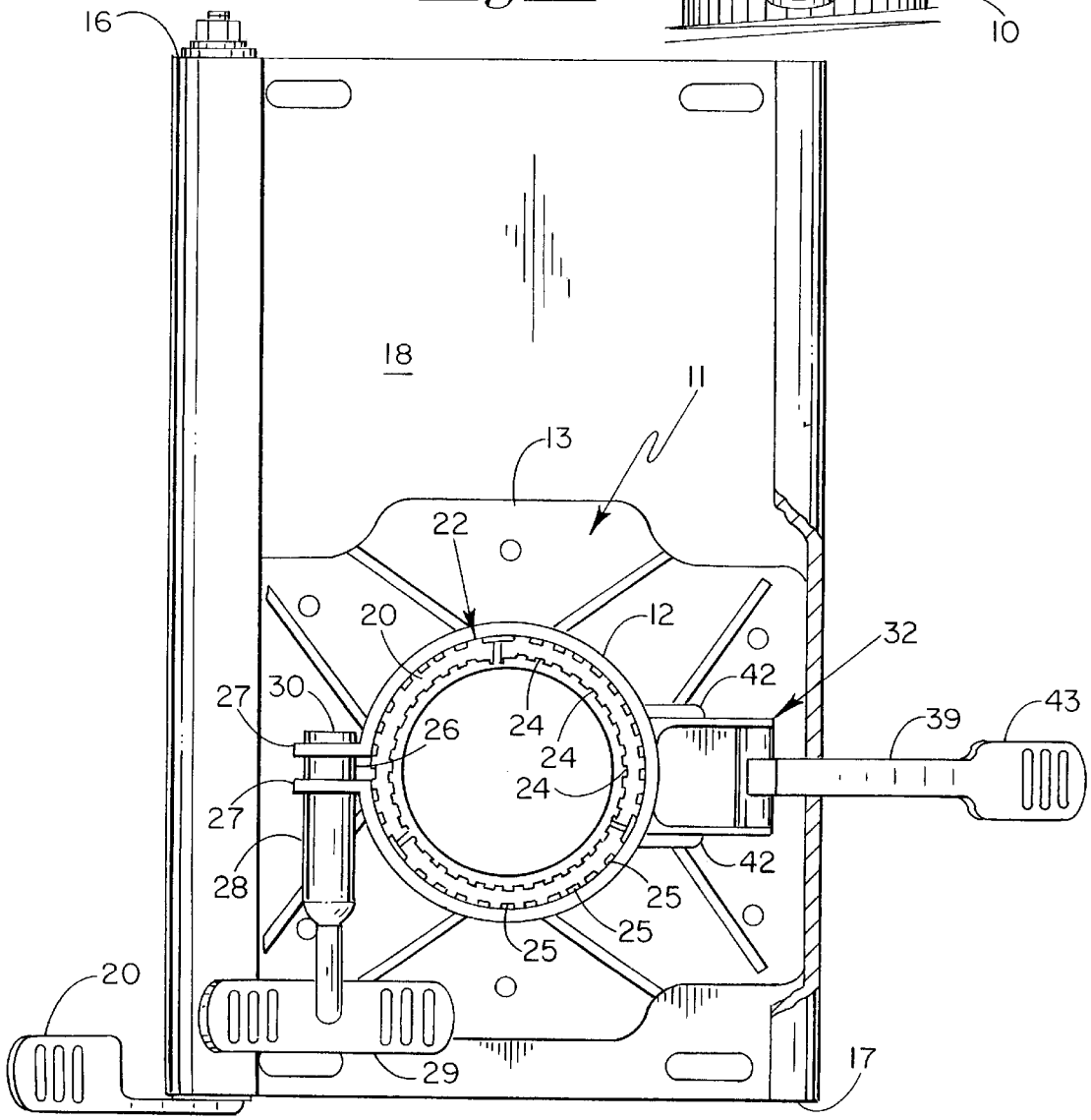

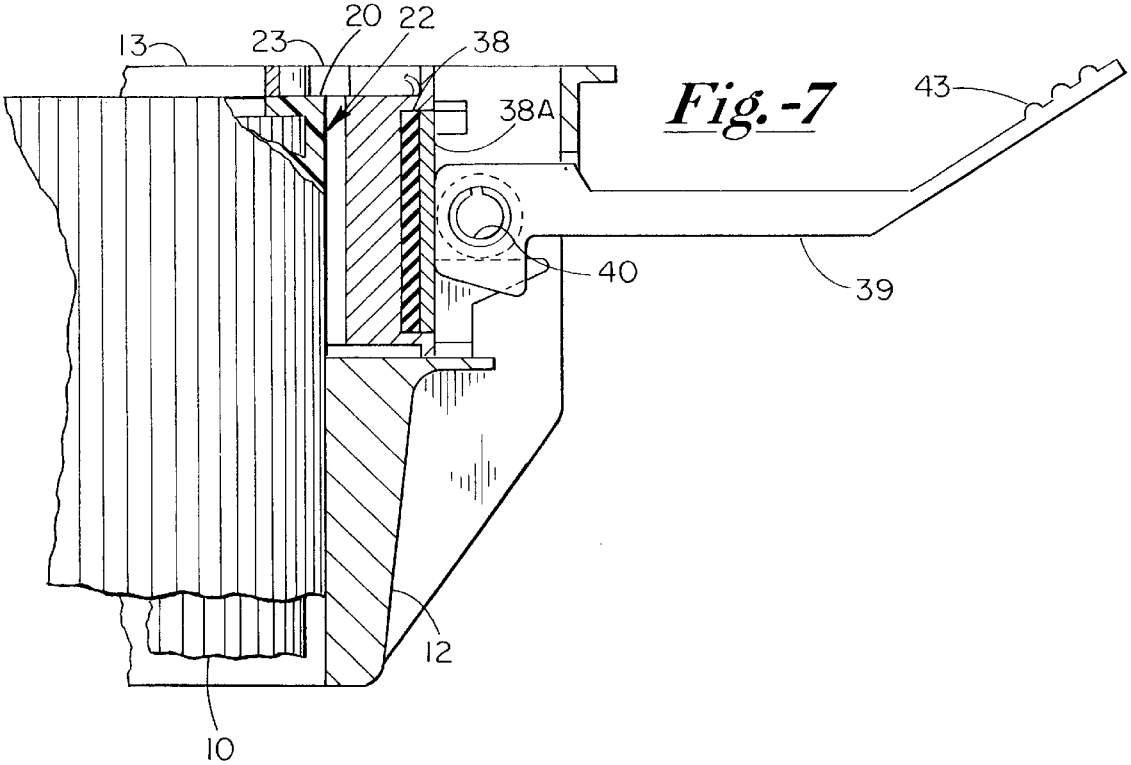
Fig.-7
Fig.-8
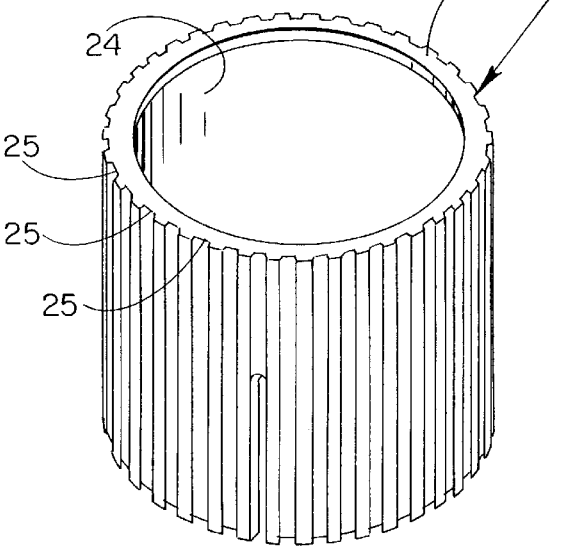

LOCK FOR ROTATABLE BOAT SEAT

This application claims the benefit of U.S. Provisional Application No. 60/037,028 filed Feb. 5, 1997.

1. Field of the Invention

Elevated boat seats are usually mounted on a supporting post or column or pillar which is anchored at its lower end to the deck of a boat. The seat is usually swivable or swingable or rotatable to allow the user to change the direction in which he or she is facing. The instant invention is directed toward providing a mechanism for releasably positively locking the swivable boat seat at any desired heading or direction.

2. Description of the Prior Art

In the past the underside of a boat seat was often coupled or engaged to the vertical supporting post or pillar by a split yoke having an annular extension which engaged the supporting post or pillar. A rod having a handle at one end and threaded at the other was turned to open or close the gap in the yoke or spider to decrease or increase the friction between the yoke and the support post in order to make it easier or more difficult to rotate the seat. If the user wanted to keep the seat from rotating any further, he or she would turn the handle as far as he or she could to tighten the yoke onto the post to increase the friction between the interior surface of the tubular extension on the spider or yoke and the supporting pillar or post. Locking then depended solely upon the degree of friction that could be imparted to these mating surfaces by virtue of screwing the knob or handle on the rod. Not only was this somewhat unreliable as far as ensuring that the boat seat wouldn't swivel or rotate any further, it also was somewhat awkward for the user.

A more positive prior art locking device utilized a ribbed support post, a movable toothed insert between the post and the yoke and a threaded rod with a knob which was turned to move the insert so that its teeth engaged the recesses between the support post ribs. This device was somewhat awkward to operate and oftentimes did not lock into the recesses but frictionally engaged the ribs on the support post.

SUMMARY OF THE INVENTION

A yoke or spider has an upper plate member for attachment or coupling to the underside of a boat seat and an annular downward extending annular or tubular section for engaging a cylindrical supporting post or pillar. A sleeve insert having outer parallel lengthwise slots or grooves around its exterior or outer surface is located within the annular opening of the spider or yoke extension and is lockingly engaged with a vertical cylindrical supporting post or pillar or column. The yoke or spider ordinarily can rotate with respect to the insert. As in the past, the yoke may be split with a rod having an attached handle which can be rotated to increase or decrease the friction between the outer surface of the insert and the annular smooth surface of the yoke extension. An opening in the wall of the yoke's annular extension contains a locking plate which has ridges or ribs or teeth facing the outer linear grooves on the insert. A lever arm is pivotally attached to the yoke and has one end opposite the locking plate and a handle at the other end. By grasping the handle, the lever can be swung so that the one end moves the locking plate radially inward so that its teeth engage the grooves or recesses in the insert to positively lock the seat-holding yoke or spider against any further rotation. This provides a positive locking feature rather than depending on the degree of surface-to-surface friction that could be obtained in the past between the supporting post and the spider. The back of the locking plate has a resilient pad with a metal plate over it and the end of the lever arm which is adjacent the locking plate is cammed so that when the arm is moved against the plate to move the locking plate into the locking position, it stays in the locking position until the user grasps the handle and moves the lever arm in the opposite direction to allow the locking plate teeth to disengage from the insert slots and thereby unlock the yoke so the seat can be rotated. This makes it considerably easier for the user to operate. A spring is engaged with the locking plate to bias it away from engagement with the insert so that when the lever arm is in the unlocking position, the locking plate teeth are moved out of engagement with the insert grooves or slots.

BRIEF DESCRIPTION OF THE DRAWINGS

FIG. 3 is a side view of the boat seat mounting mechanism;

FIG. 4 is an underside or bottom view;

FIG. 7 is a partial vertical section showing detail of the locking mechanism in the preferred embodiment; and FIG. 8 is a perspective view of the locking insert utilized in the preferred invention.

DESCRIPTION OF THE PREFERRED EMBODIMENTS

Figure 1:
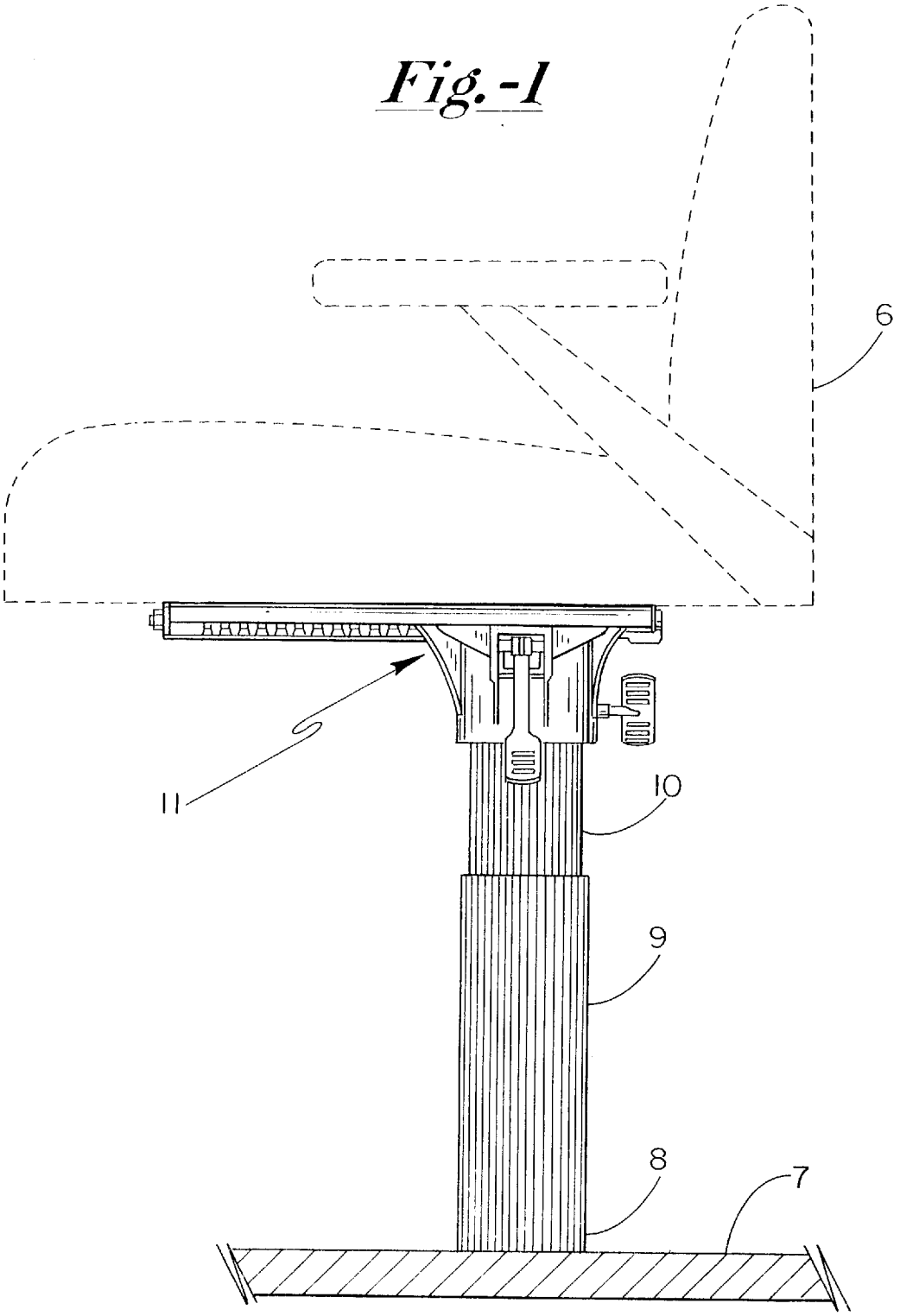
FIG. 1 is a side view of an elevated boat seat utilizing the instant invention.
Figure 2:
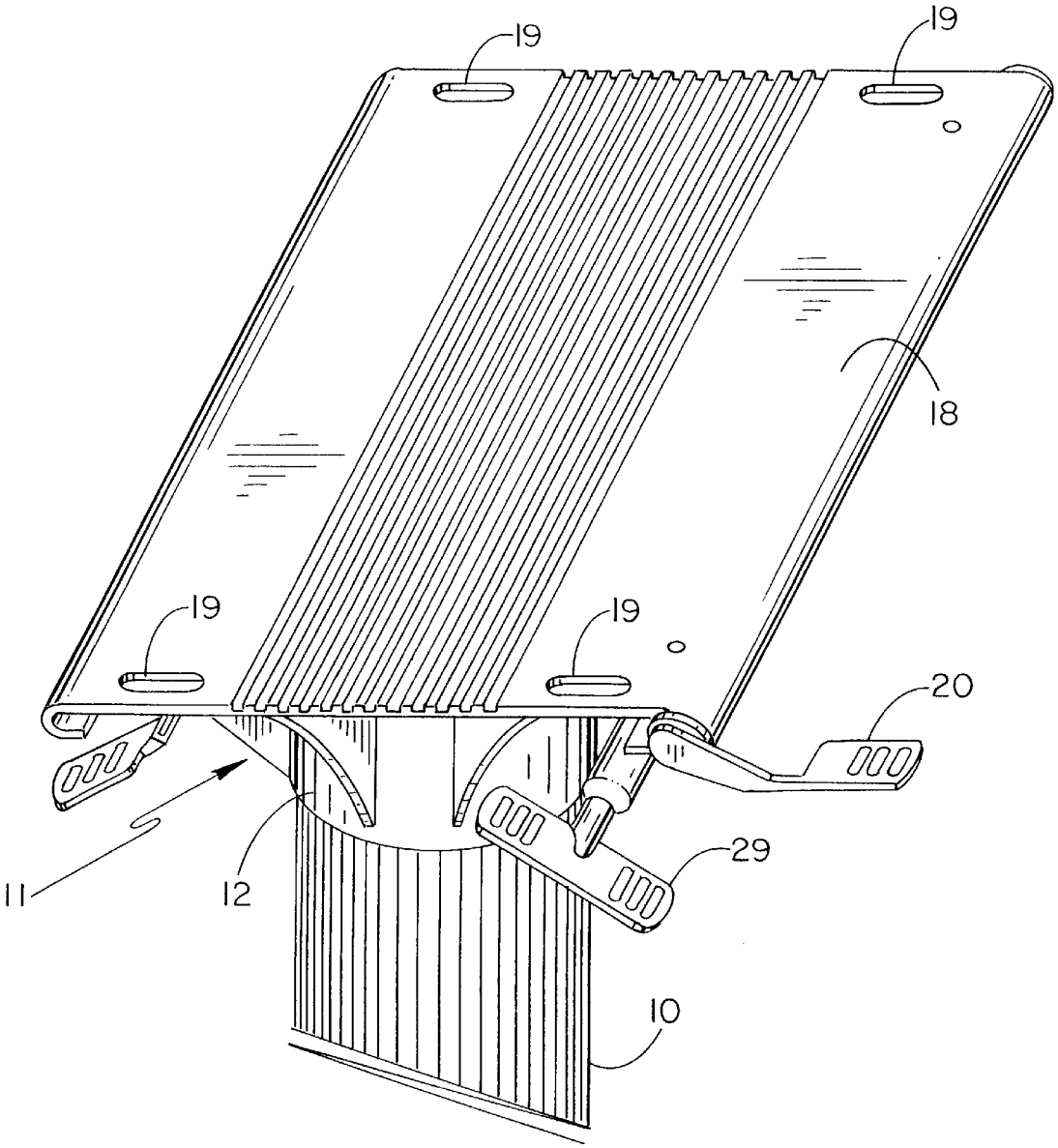
FIG. 2 is a perspective view of a boat seat mounting mechanism incorporating the teachings of the instant invention.
Figure 5:
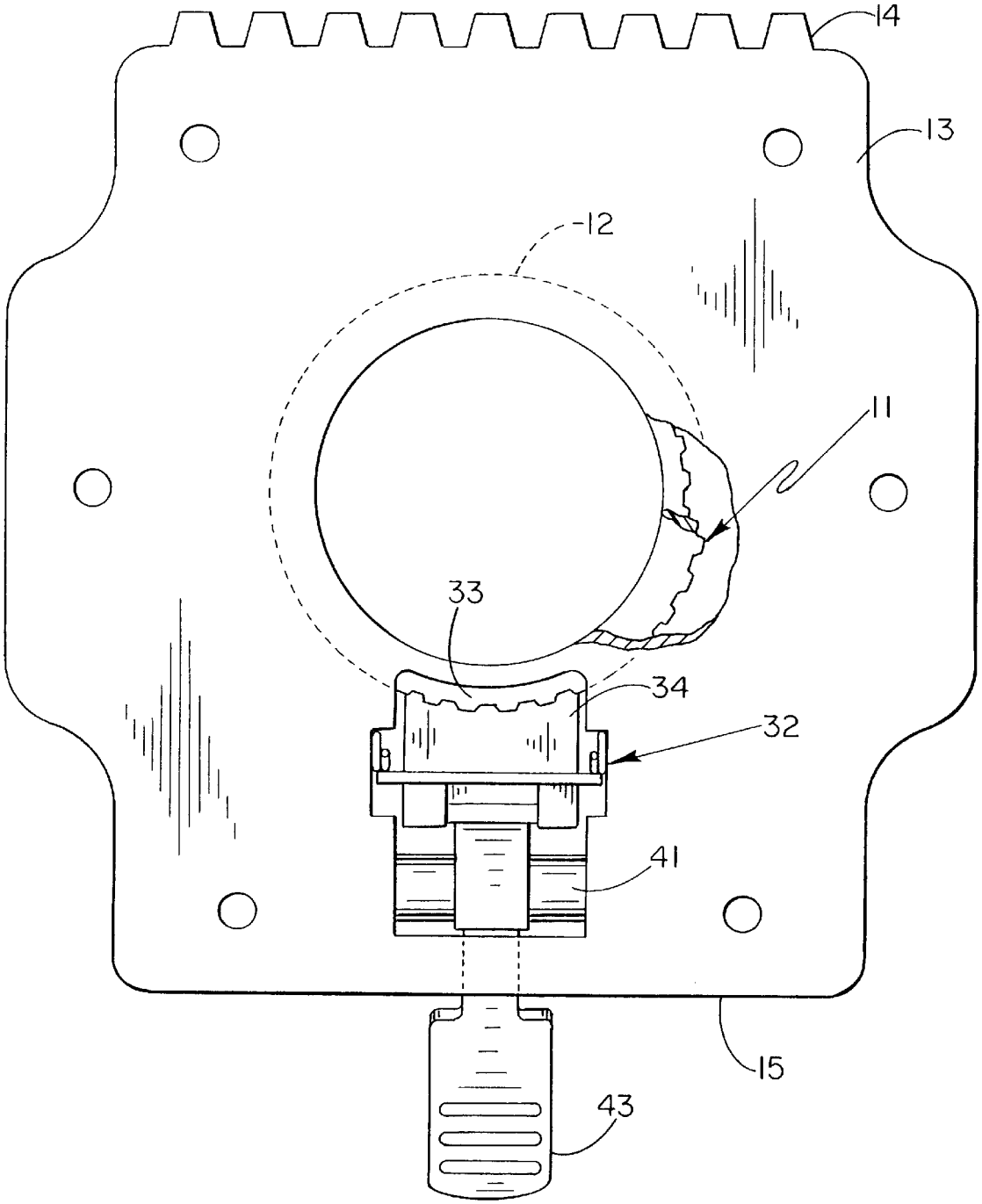
FIG. 5 is a top view of a preferred embodiment of the invention.
Figure 6:
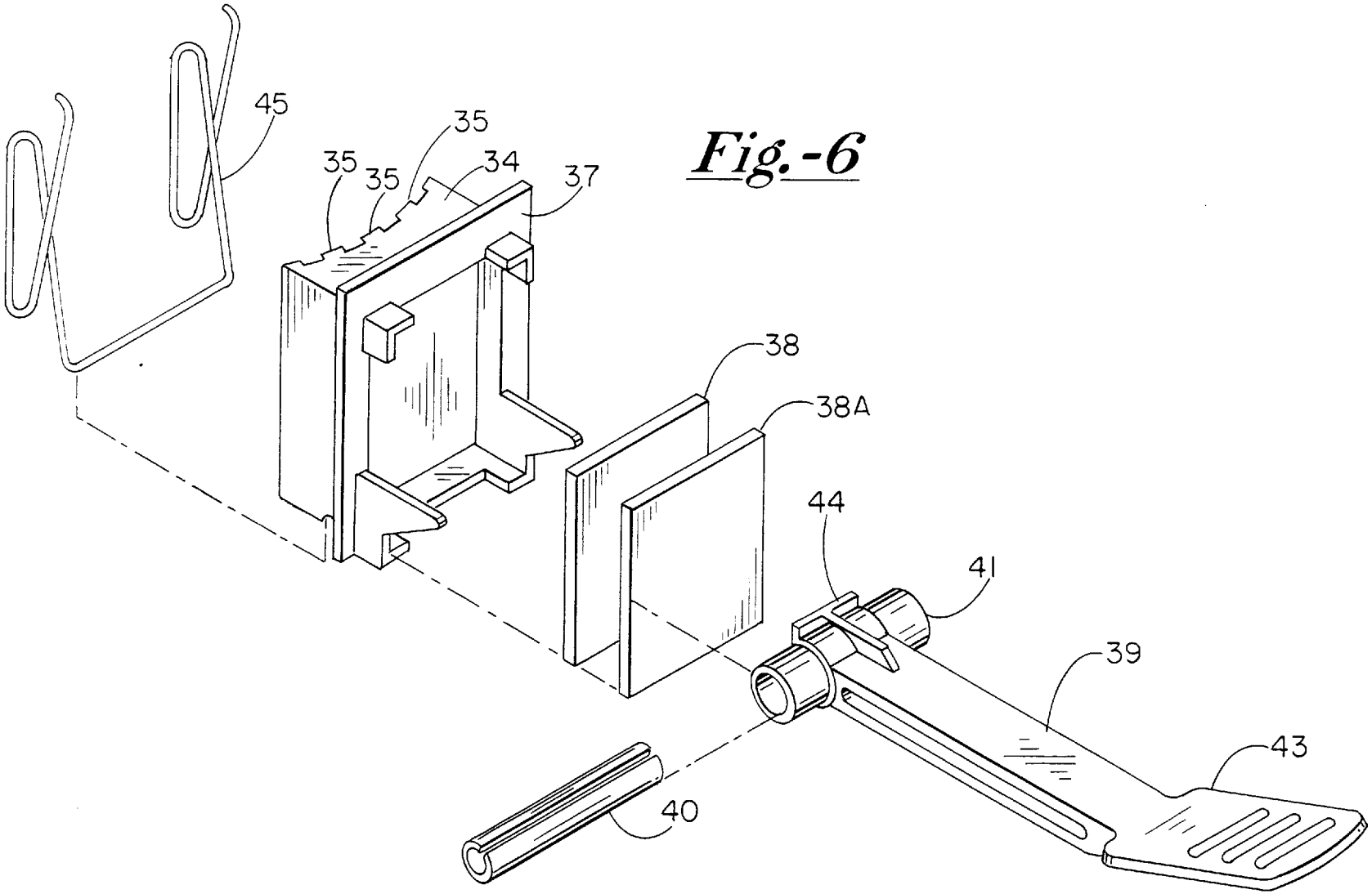
FIG. 6 is a blow-apart diagrammatic illustration of the locking arm and locking plate assembly utilized in the preferred embodiment of the invention.

Copending application by the same inventors as the instant application titled "LOCK FOR SLIDE ADJUSTMENT OF BOAT SEAT OR TABLE TOP", Ser. No. 08/888,548, describes an elevated slidably adjustable boat seat with a positive locking arrangement. The instant invention can be used in conjunction with the aforementioned invention so that the elevated boat seat is slidably adjustable and rotatably or swivably adjustable so it can be positively releasably locked at a forward or rearwood location as well as in the direction that it is facing.

Conventionally a rigid circular support post or column 10 extends vertically upward from a tubular supporting pillar 9 which is attached at its base in some convenient fashion to the boat deck 7. Conventionally pillar 9 contains a suitable mechanism for adjusting the height of column 10 to permit a height adjustment of the attached boat seat 6, shown in dashed line.

A spider or yoke identified generally by reference numeral 11 has a downward projecting annular section 12 which is coupled to support post 10 and has an integrally cast horizontal upper plate 13 which has two parallel outer edges 14 and 15 slidably engaged in tracks 16 and 17 on the underside of boat seat plate member 18. Openings 19 in plate member 18 are provided for fasteners to attach to the underside of boat seat 6 to secure it in place on plate 18. As described in more detail in the aforementioned copending patent application, plate 18 with seat attached can be slidably moved with respect to plate 13 to adjust the forward and/or backward position of the seat and then releasably locked in place with a conveniently accessible handle member 20.

A hollow cylindrical insert 22 which is preferably made out of some relatively rigid plastic material is located in the annular opening of annular extension 12. An inward extending lip 20 at the upper end of insert 22 rests against the bottom of an overhang 23 at the annular opening of annular section 12. Insert 22 rests over the outside of column or post 10 and a series of lengthwise recesses 24 on the interior of insert 22 engage corresponding lengthwise ribs or teeth on the outside of support column 10 so that the insert is mounted on support column 10 so it is not rotatable with respect thereto. The top edge of column 10 rests against the underside of lip 20 on insert 22. The outer surface of insert 22 has another set or series of parallel lengthwise slots or grooves 25 over its entire circumference. The inner surface of annular section 12 is smooth. Conventionally annular section 12 may be split as shown at 26 with a pair of parallel ears 27 having openings therethrough to accommodate an elongated threaded bolt 28. One end of threaded bolt 28 has a winged handle 29 and the other end has a threaded nut 30. In conventional fashion handle 29 can be rotated to tighten or loosen the fit between the insert 22 and annular section 12 to increase or decrease the friction between the two so that the spider, and correspondingly the boat seat, may be more difficult or easier to rotate but yet does not positively lock the seat in place. This is similar to what has been available in the past.

In order to positively or affirmatively lock the yoke, and correspondingly the boat seat, facing in a desired direction a locking mechanism identified generally by reference numeral 32 is provided. In an opening at 33 through the wall of section 12 is a locking plate 34 which has a series of elongated teeth or ribs or ridges 35 paralleling and facing the slots or grooves 25 of insert 22. The face of locking plate 34 which faces insert 22 has a curvature generally conforming to the outer curvature of insert 22 so that when locking plate 34 is moved radially inwardly teeth 35 will engage slots 25. Locking plate 34 is mounted on a holder or carriage 37 which is slidably mounted in a track in annular extension 12 at opening 33. Mounted on carriage or holder 37 on the side opposite locking plate 34 is a resilient pad 38 which has an overlaying metal plate 38A. A lever arm 39 has a pivot pin 40 in a cylindrical housing 41 by which lever arm 39 is pivotally attached between a pair of arms or ears 42 extending outward from annular section 12. At its outer end lever arm 39 has a handle 43 and at its opposite end adjacent and in contact with plate 38A lever arm has a cam 44. In operation, handle 43 is grasped to swing lever arm 39 about pin 40 to move cam 44 against plate 38A and pad 38 to push or force holder 37 and locking plate 34 radially inward in opening 33 of extension 12 so that teeth 35 engage and rest in the slots 25 of insert 22 thereby locking the yoke and the boat seat positively or affirmatively against any further rotation. The combination of the cam 44 with the pad 38 and plate 38A acts to hold lever arm 39 in the locking position against the action of a spring member 45 which is mounted against the outer edge of holder 37 in a fashion to urge or bias holder 37 and locking plate 34 radially outward or out of engagement with insert 22. When handle 43 is grasped to move lever arm 39 out of the locking position the force applied to move locking plate 34 radially inward is removed so that the biasing action of spring 45 moves holder 37 and locking plate 34 radially outward to ensure that teeth 35 are disengaged from slots 25 thereby enabling the yoke and the boat seat to be rotated or swiveled.

We claim:

1. A locking mechanism for a rotatable boat seat comprising:

a vertical tubular support having a series of vertical grooves with adjacent flats over its outer surface;

a yoke member having a horizontal boat seat plate for attachment to the underside of a boat seat and a generally centrally located annular extension below said plate having a generally smooth internal annular surface, said tubular support slidably engaging said annular extension such that said yoke is rotatable with respect to said support;

an opening through the wall of said yoke annular extension;

a locking plate movably located in said yoke opposite said opening, said locking plate having ribs for engaging the outer grooves on said support; and a lever arm pivotally attached to said yoke with an end of said lever arm engaging said locking plate to selectively move said locking plate radially into engagement with said insert grooves to rotatably lock said yoke.

2. A locking mechanism for a rotatable boat seat as described in claim 1 wherein said end of said lever arm includes:

a cam surface engaging said locking plate for releasably holding said locking plate in locking engagement with said insert grooves.

3. A locking mechanism for a rotatable boat seat as described in claim 2 further including:

a resilient layer between said end of said lever arm and said locking plate.

4. A locking mechanism for a rotatable boat seat as described in claim 3 further including:

a spring member engaged with said locking plate, said spring member biasing said locking plate out of engagement with said insert grooves when said lever arm is operated to release the locking engagement.

5. A locking mechanism for a rotatable boat seat as described in claim 1 wherein said support comprises:

a vertical tubular column having vertical external grooves; and a hollow tubular insert having internal ridges and external grooves with adjacent flats, said insert coupled to said column with the insert internal ridges engaging the column external grooves such that said insert is rotatably locked to said column;

said insert slidably engaged in said yoke annular extension.

6. A locking mechanism for a rotatable boat seat as described in claim 5 wherein said locking plate ribs engage the outer grooves of said insert to rotatably lock said yoke.

7. A locking mechanism for a rotatable boat seat as described in claim 5 wherein said insert is a rigid plastic insert.

8. A locking mechanism for a rotatable boat seat as described in claim 5 wherein said tubular column has an upper edge and said insert has a radially extending lip at one end resting on the upper edge of said tubular column.

* * * * *